US005396710A

United States Patent [19]

Battaglia

[11] Patent Number: 5,396,710

[45] Date of Patent: Mar. 14, 1995

[54] CARPENTRY BUILDING TOOL AND METHOD OF USING SAME

[76] Inventor: Patrick Battaglia, 19 Carolynn Rd., Elizabeth, N.J. 07201

[21] Appl. No.: 243,244

[22] Filed: May 16, 1994

[51] Int. Cl.[6] ..... B43L 7/027

[52] U.S. Cl. ..... 33/429; 33/474; 33/481; 33/613; 33/563

[58] Field of Search ..... 33/474, 481, 613, 562, 33/563, 566, 567, 429

[56] References Cited

U.S. PATENT DOCUMENTS

| | | | |
|---|---|---|---|
| 3,169,320 | 2/1965 | Currie | 33/429 |
| 4,499,666 | 2/1985 | Smith | 33/562 |
| 4,573,276 | 3/1986 | Torczon | 33/481 |
| 4,607,438 | 8/1986 | DeFrange | 33/562 X |
| 5,140,755 | 8/1992 | Simmons, Jr. | 33/474 |

*Primary Examiner*—Alvin Wirthlin
*Attorney, Agent, or Firm*—Ezra Sutton

[57] ABSTRACT

A generally U-shaped carpentry building tool is provided, which includes a reference plate member for placement on one or more building members and having an inner edge and outer marking edge; a first marking guide arm connected at 90° to one end of the reference plate member; a second marking guide arm connected at 90° to the other end of the reference plate member to form a generally U-shaped tool; a first lip member connected to one edge of the reference plate member to form a first right angle, corner-engaging member for engaging the corner of the one or more building members to properly position the reference plate member relative to the one or more building members; and a second lip member connected at 90° to the center of the second marking guide arm to form a second right angle, corner-engaging member transverse to the first corner-engaging member for marking off a predetermined position to provide the proper centerline alignment of a second building member relative to the one or more building members.

3 Claims, 5 Drawing Sheets

CARPENTRY BUILDING TOOL AND METHOD OF USING SAME

FIELD OF THE INVENTION

The present invention relates generally to tools for laying out the position of studs on top and bottom plates or the like and, more particularly, to a carpentry building tool that may be quickly and easily used for the precise center-to-center spacing and collocation of studs, floor joists, rafters, decking, sheet rock, plywood, particle board sheets, dry wall sheets, wall panel sheets, and the like.

DESCRIPTION OF THE PRIOR ART

Carpentry building tools of different designs for spacing of studs and other purposes have been disclosed in the prior art. Such tools include simple tape measures, folding rulers, layout squares, carpenter's squares, and the like.

For example, U.S. Pat. Nos. 5,129,153; 4,499,666; 4,625,415; 4,607,438; 3,834,033; and 3,169,320 disclose devices that allow studs to be arranged in a spaced relation during construction and/or holding them at the desired spacing while they are being secured. However, such tools are generally only adapted to facilitate spacing but have limited applications, and there is a need for having a plurality of these devices for construction use, which results in an increased expense to the user. Further, such prior art tools have the disadvantage that they can only lay out one stud spacing at a time. Also, they do not provide a system to compensate for the $\frac{3}{4}$ inch adjustment necessary in locating the second stud in a series to be placed on a plate member.

U.S. Pat. Nos. 1,048,333; 2,652,629; and 5,140,755 disclose devices that are generally used for marking a ledger notch, marking the header and sole plate for stud width, and/or a simple combination measurement square. However, these tools also have limited application in use.

BACKGROUND OF THE INVENTION

In the construction of buildings by carpenters, frame walls made out of lumber or other such framing materials are used. The accepted standard and practice in the United States for building walls uses a plurality of vertical parallel studs, spaced 16 inches apart from centerline to centerline. The same principles apply for uniform spacing between floor joists and roof rafters. The system provides a properly-aligned fastening surface for the perimeter edges of 4 foot×8 foot sheet rock, plywood, particle board sheets, and other building members.

An object of the present invention is to provide a carpentry building tool that is simple to use, inexpensive to manufacture, has a variety of different sizes, and which provides precise and accurate spacing measurements for studs for both the header and sole plates of a wall frame.

Another object of the present invention is to provide a carpentry building tool that provides precise and accurate spacing for vertical wall studs, sheet rock, floor joists, rafters, decking, and the like.

It is further object of the present invention to provide a carpentry building tool for stud spacing and framing, a template for marking centerlines, a squaring tool, a nail guide, and a marking tool for laying out spaced-apart perpendicular lines.

SUMMARY OF THE INVENTION

In accordance with the present invention, there is provided an improved carpentry building tool that may be used for all aspects of laying out and marking of various framing dimensions. The present invention provides a generally U-shaped carpentry building tool that increases efficiency and accuracy, and decreases the time needed for the various framing aspects of a facility under construction.

This tool includes a rigid horizontal reference plate member of a predetermined length having a straight edge on its front side and two vertical marking guide arms, all positioned in the same plane, and attached to opposite ends of the reference plate member at 90° angles. Each vertical marking guide arm is precisely the width of a 2×4, 2×6, 2×8 stud, etc., which measures 1-$\frac{1}{2}$ inches in width for a standard stud size. The reference plate member has a lip member disposed downwardly at a 90° angle for engaging one side of a workpiece, such as a 2×4, 2×6, 2×8 stud, etc. The left vertical marking guide arm also has a lip member disposed upwardly at a 90° angle for engaging a corner of the end of a workpiece, such as 2×4, 2×6, 2×8, etc., and formed in the arm is an elongated opening which may be used as a nail guide for sheet rock, paneling, etc. This lip member is located on the left marking guide arm, and when used in its engaged position, it automatically provides the $\frac{3}{4}$ inch adjustment or measurement for properly locating the second vertical stud, so there is the required 16 inch centerline-to-centerline spacing. As a result, the tool provides the precise fastening surface at the perimeter edges for sheet rock, plywood, veneer wall panels, and the like materials that are 4 foot×8 foot in dimension.

The carpentry building tool of the present invention may be used in all facets of construction within the interior or exterior of a building, including such items as walls, floors, ceilings, a ridge board for roof rafters, outdoor decking, installation of plaster board, waterproof sheet rock, dry walls, wall paneling, etc. The present invention can also be used as a framing template, as a centerline template, a nail guide, a squaring tool, or a T-square tool for laying out perpendicular lines to a 90° angle. This carpentry building tool may be constructed out of very durable heavy-duty plastic or metal materials, such as aluminum or stainless steel. The tool of this present invention is easy to use and has no moving parts. It should be understood that the present invention may also be made in other standardized sizes where the centerline-to-centerline spacing is 12 inches, 16 inches, 24 inches, or any other length that needs standardized spacing.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

The carpentry building tool 10 is shown in detail in FIGS. 1 to 6. The carpentry building tool 10, as shown in FIG. 1A, is formed from a flat piece of sheet metal of substantial rigidity and durability, such as aluminum or stainless steel. Alternatively, tool 10 may be molded or stamped to the desired shape by using a heavy-duty plastic of substantial rigidity.

Figure 1A:
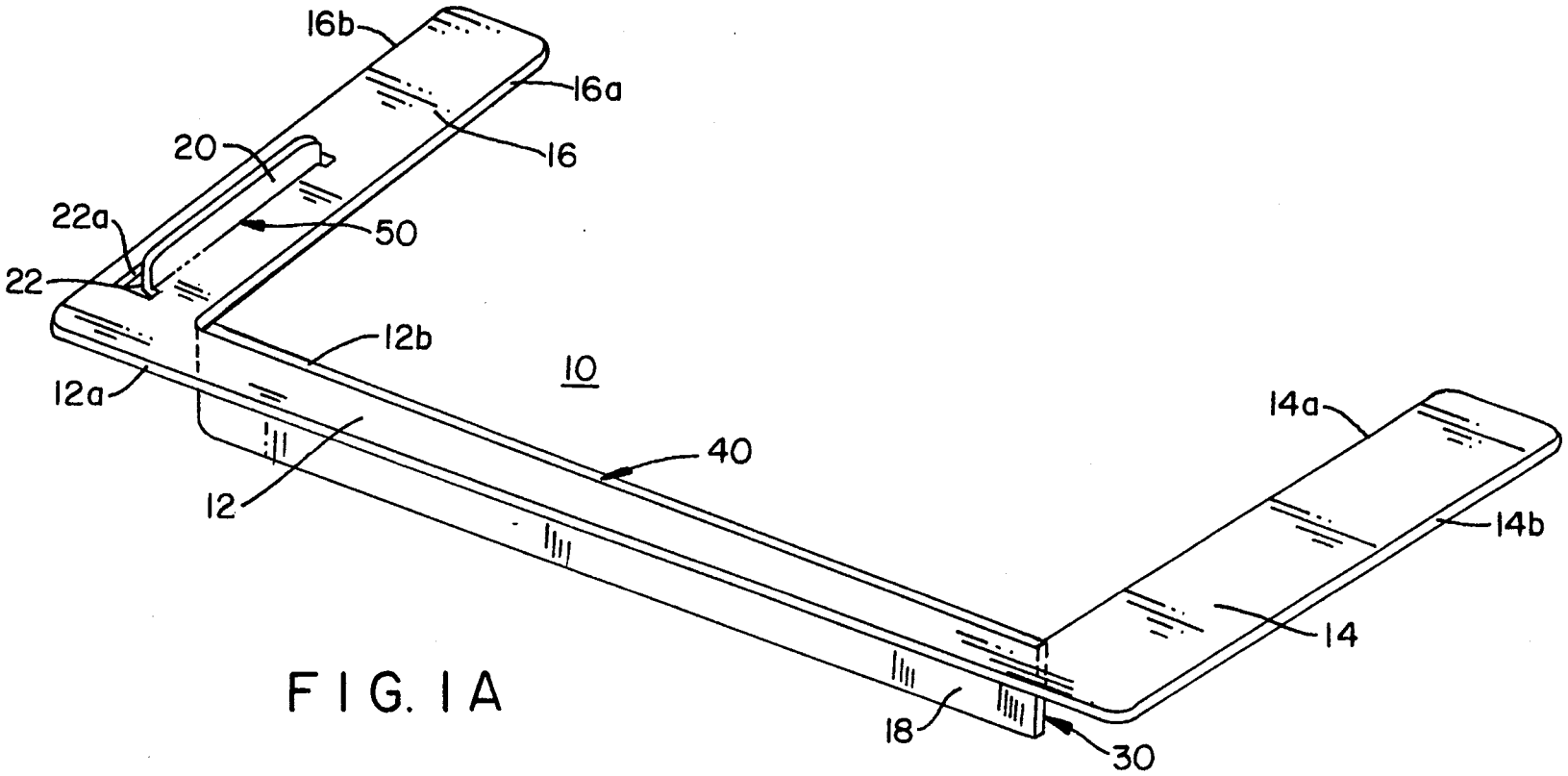
FIG. 1A is a perspective view of the carpentry building tool in accordance with the present invention showing all of its parts.
Figure 1B:
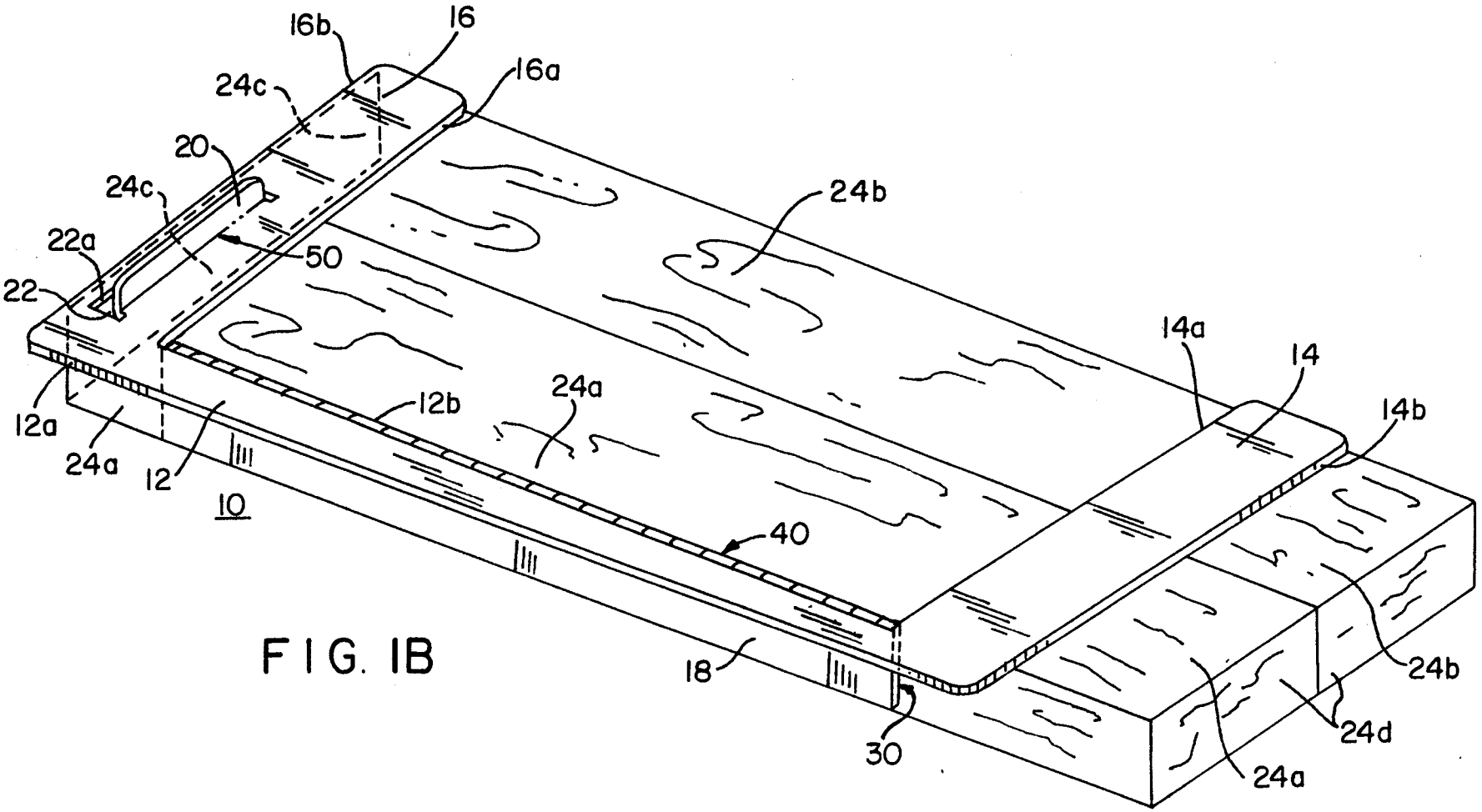
FIG. 1B is a perspective view of the carpentry building tool in accordance with the present invention illustrating the tool in use on two side-by-side plates for simultaneously marking them with stud locations.
Figure 4:
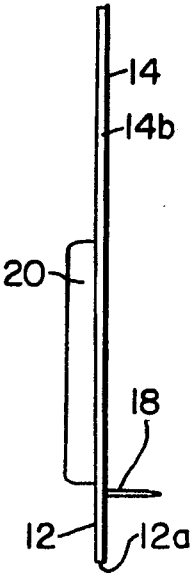
FIG. 4 is a side view of the carpentry building tool in accordance with the present invention.
Figure 2:
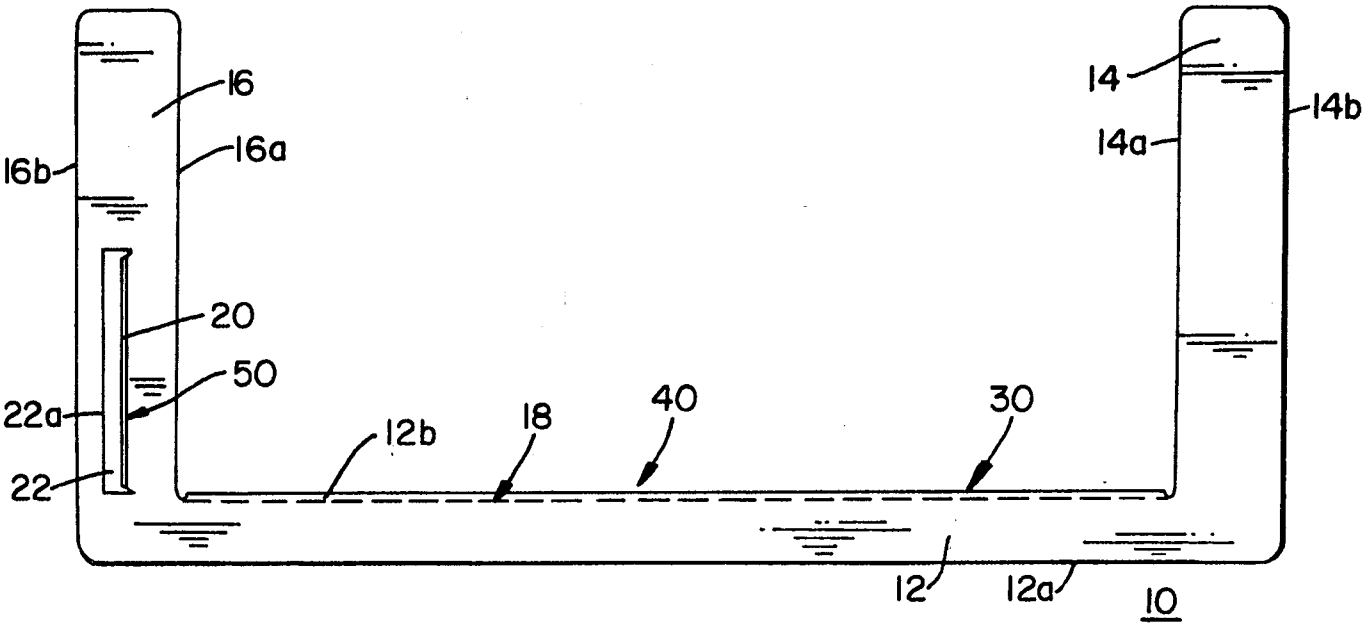
FIG. 2 is a top plan view of the carpentry building tool in accordance with the present invention.
Figure 3:
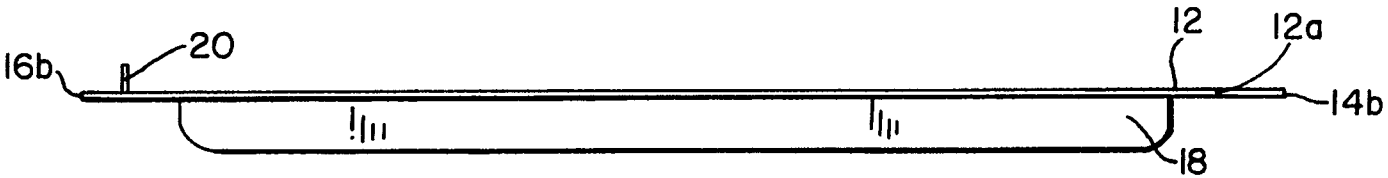
FIG. 3 is a front view of the carpentry building tool in accordance with the present invention.
Figure 5:
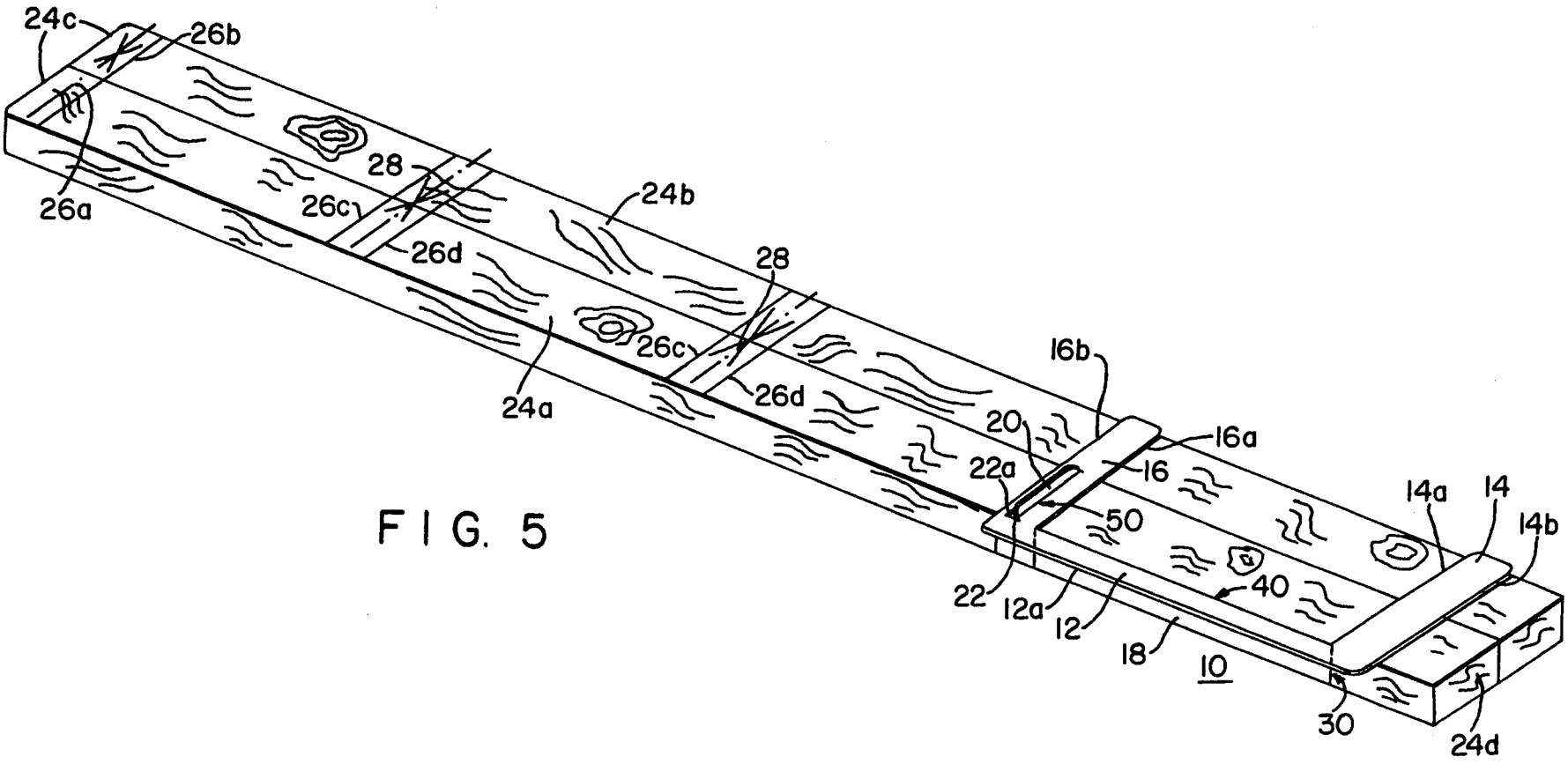
FIG. 5 is a perspective view of the carpentry building tool in accordance with the present invention with the present invention depicting the tool in use in which two side-by-side plates have been marked with locations for receiving vertical wall studs.
Figure 6:
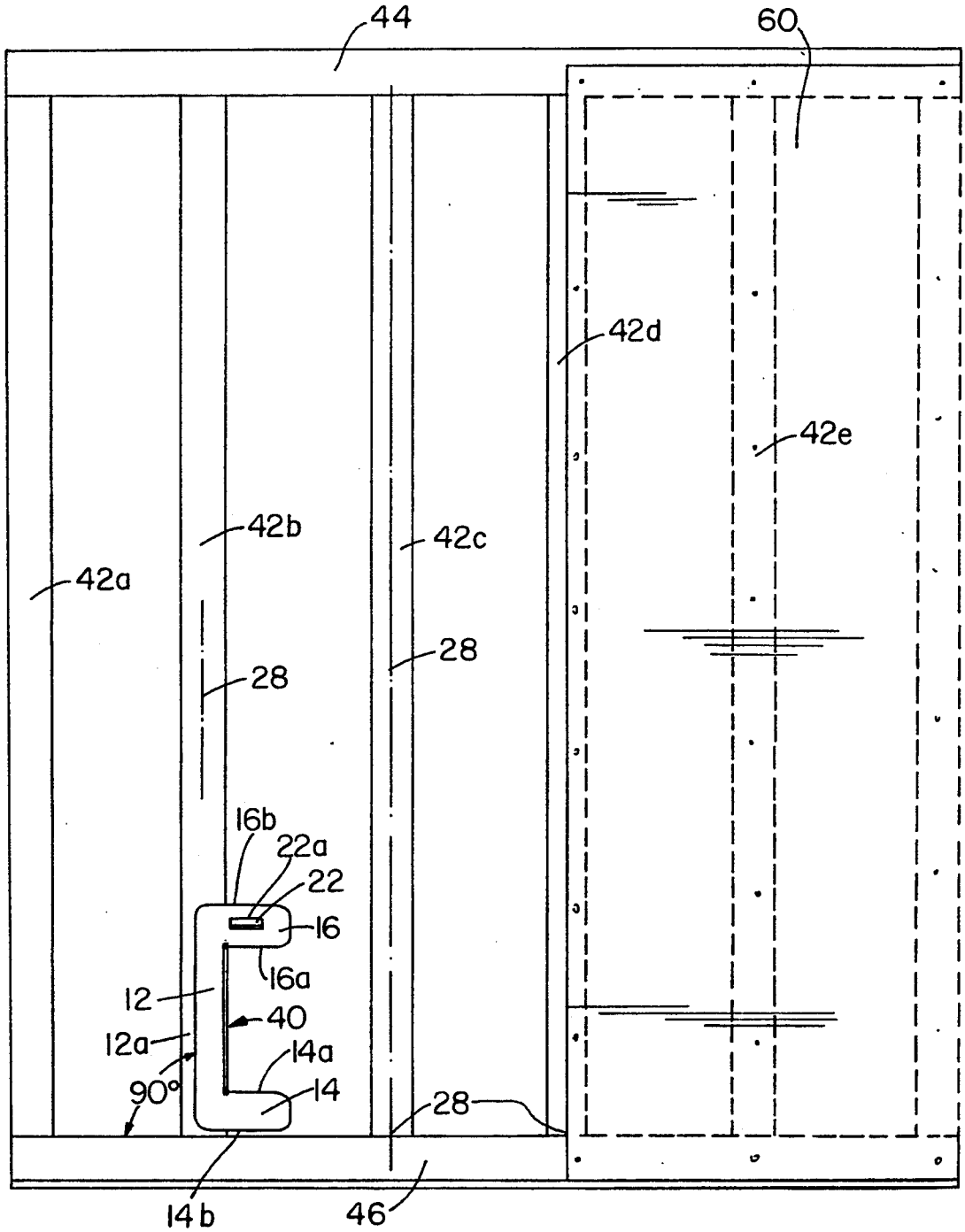
FIG. 6 is a frontal view of the carpentry building tool in accordance with the present invention depicting the tool in use in which vertical wall studs have been aligned at a 90° angle to the header and sole plates, as shown.

The carpentry building tool 10 is formed in the shape of a rectangular "U," as depicted in detail by FIGS. 1A and 2, and includes an elongated, horizontal, and rigid reference plate member 12 being integrally formed at its ends with a right vertical marking guide arm 14 (first marking guide are) and a left vertical marking guide arm 16 (second marking guide arm) in which the reference plate 12 and marking guide arms 14 and 16 all lie in the same plane. Each vertical marking guide arm 14 and 16 is at a 90° angle with plate 12 and is exactly 1-½ inches wide, whereas the horizontal reference plate 12 is 1-⅛ inches wide. The horizontal reference plate 12 has a marking edge **12*a* and an inner edge 12*b*, which is integrally formed with a lip member 18, disposed downwardly at a 90° angle, for engaging one side of a 2×4 stud 24*a*, as shown in detail in FIGS. 1B and 5. Lip member 18 forms a side-engaging member 30 for engaging the side of a lumber workpiece 24*a*, which may be of various sizes, such as 2×4's, 2×6's, 2×8's, etc., for properly positioning the tool relative to the building member to prepare the tool for marking. The reference plate member 12 and lip member 18 together form a right angle, corner-engaging member 40, and as shown in FIG. 6, it is used to properly align vertical studs 42*a* to 42*e* along the plate members in a perpendicular position of exactly a 90° angle relative to the plate members 44 and 46**.

The left vertical marking guide arm 16 has a centrally-located lip member 20 disposed upwardly at a 90° angle and has a marking hole 22 disposed therein. The marking guide arm 16 and lip member 20 cooperate to form a right angle, corner-engaging member 50 for engaging the corner of a stud end's upper edge **24*c*. As shown in FIG. 5, the corner-engaging member 50 and marking hole 22 are used for the initial marking of a ¾ inch line 26*a*, which then provides a reference for properly spacing centerline 28 for receiving the second vertical stud 42*b*, as shown in FIG. 6**.

The right and left marking guide arms 14 and 16 each have inner marking edges **14*a* and 16*a* and outer marking edges 14b and 16*b*. As shown in FIG. 5, the aforementioned marking edges 14*a* 14*b*, 16*a*, and 16*b* are used to transcribe straight lines across the surfaces of building members or studs 24*a* and 24*b*. In addition, marking edge 12*a* may be used as a straight edge for line making and/or as the working edge for providing a right angle alignment. Further, marking edge 22*a* may be used as a marking line for nail alignment in the installation of sheet rock, as shown in FIG. 6**.

The physical measurements of the carpentry building tool 10 are as follows: the elongated or longitudinal reference plate member 12 measures 14-½ inches in length and 1-⅛ inches in width; the vertical or transverse marking guide arms 14 and 16 measure 8 inches in length and 1-½ inches in width; the lip member 18 measures 14-¼ inches in length and ¾ of an inch in width; the lip member 20 measures 3-⅜ inches in length and ⅜ of an inch in width; the marking slot 22 measures 3-½ inches in length and 5/16 of an inch in width; and the material thickness of building tool 10 is about 1/16 of an inch.

OPERATION OF THE PRESENT INVENTION

When laying out a wall for framing, the carpentry building tool 10 may be used in several different ways for doing the wall installation. To lay out a wall of a predetermined length, the carpenter lays out 2 or more header and sole plates 44 and 46 of equal lengths and sets them side by side, as shown at **24*a* and 24*b* in FIG. 5. Then the carpenter lines up the two ends of studs 24*a* and 24*b*, so that the upper edges 24*c* of both studs are in a straight line. Then, as shown in FIG. 5, the carpentry building tool 10 is placed across both studs 24*a* and 24*b*, and tool 10 is aligned with the side-engaging member 30 engaging the side of stud 24*a* by a gentle inward push. The building tool 10 is then moved to the left, and marking edge 16*b* of marking guide arm 16 is aligned with upper edge 24*c* of stud ends 24*a* and 24*b*, so that they are both perfectly flush with marking edge 16*b*. The carpenter then draws a pencil marking line 26*b* across the studs along marking edge 16*a* of left marking guide arm 16, and the carpenter then marks an "X" in the defined space to show where the first vertical stud 42*a* is to be positioned on plates 44 and 46, as depicted in detail in FIG. 6**.

The carpenter then rotates the building tool 10 180°, such that the corner-engaging member 50 is aligned with the upper edge **24*c* of stud ends 24*a* and 24*b*. This procedure will provide the precise location of the second vertical stud 42*b*, as shown in FIGS. 5 and 6. That is, the carpenter then draws pencil marking lines 26*c* and 26*d* along marking edges 14*a* and 14*b* of marking guide arm 14, thus defining the precise location of the second stud 42*b*** and marking it with an "X" in the defined space.

The carpenter then again rotates the building tool 180°, such that the side-engaging member 30 is again aligned with the side of stud **24*a*. The left vertical marking guide arm 16 is then positioned in the second stud space 42b, and its edges are aligned with the marking lines 26*c* and 26*d*. This procedure then positions the right vertical marking guide arm 14 at the precise location for the third vertical stud 42*c*, as shown in FIGS. 5 and 6. The carpenter then again draws pencil marking lines 26*c* and 26*d* along marking edges 14*a* and 14*b* of marking guide arm 14, thus defining the space for third stud 42*c*** and marking it with an "X" in the defined space.

This latter procedure is repeated along both faces of plates 24*a* and 24*b* until the locations or spaces for all the studs 42*d*, 42*e*, and 42*f* are marked with an "X" in the defined spaces. The last stud space of a given length of header and sole plates 44 and 46 is marked by sliding the building tool 10 to the right and aligning edge 14*b* with the upper edge 24*d* of both stud ends 24*a* and 24*b*. The carpenter then draws a single pencil line along edge 14*a* of right marking guide arm 14. This defines the last stud space, which is marked with an "X" for a given length of header and sole plates 44 and 46.

The building tool 10 may also be used as a right angle squaring tool, as depicted in detail in FIG. 6. In operation, the carpenter positions the building tool 10, such that the marking edge 14*b* of marking arm 14 is aligned in a horizontal manner with the face of either the header plate 44 or sole plate 46. Then a given stud, such as 42*b*, is placed in its defined space and is aligned in a vertical position with the corner-engaging member 40, which insures that each stud is at a proper 90° angle relative to the header and sole plates 44 and 46. This step can be repeated for each vertical stud 42 that is placed between header and sole plates 44 and 46, as shown in FIG. 6, until the wall is completely framed out.

Still another use for the carpentry building tool 10 is that of a nail guide. In operation, the corner-engaging member 50 is rotated 90° from the position shown in FIG. 6, so that corner-engaging member 50 is aligned with the edge of a 4 foot×8 foot sheet rock panel 60, and a pencil line is marked along the marking edge 22*a*. This positions the nails to be ¾ of an inch in from the edge of the sheet rock 60.

ADVANTAGES OF THE PRESENT INVENTION

The primary advantage of the present invention is that the carpentry building tool 10 provides precise and accurate spacing for vertical wall studs, sheet rock, floor joists, rafters, decking, and the like. Further, building tool 10 is simple and easy to use, and requires no fastening means for securing of studs to the header and sole plates 44 and 46.

Another advantage of the present invention is that the carpentry building tool 10 provides not only stud spacing measurements but may also be used as a framing and centerline template, a right angle squaring tool, or a nail guide marking tool, whereas prior art tools have limited uses.

Still another advantage of the present invention is that the carpentry building tool 10 is easy to use for all carpentry needs, is made of durable construction materials for long-lasting use, and the cost of manufacturing is inexpensive.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A generally U-shaped carpentry building tool, comprising:

a) a reference plate member for placement on at least one building member and having an inner edge and outer marking edge;

b) a first marking guide arm connected at 90° to one end of said reference plate member;

c) a second marking guide arm connected at 90° to the other end of said reference plate member to form a generally U-shaped tool;

d) a first lip member extending in a first direction perpendicular to said plate member and connected to one edge of said reference plate member to form a first right angle, corner-engaging member for engaging a corner of said at least one building member to properly position said reference plate member relative to said at least one building member;

e) said first marking guide arm having first and second marking edges for locating a predetermined position along said at least one building member for receiving a second building member at a right angle;

f) said second marking guide arm having first and second edges for locating a predetermined position along at least said one building member for receiving a third building member at a right angle; and g) a second lip member extending in a second direction opposite to said first direction and connected at 90° to the center of said second marking guide arm to form a second right angle, corner-engaging member transverse to said first corner-engaging member for marking off a predetermined position to provide the proper centerline alignment of said second building member relative to said at least more building member.

2. A carpentry building tool in accordance with claim 1, wherein said second marking guide arm includes a marking hole defining a marking edge for locating nails.

3. A method of using a generally U-shaped carpentry building tool having a reference plate member for placement on at least one building member and having an inner edge and outer marking edge; a first marking guide arm connected at 90° to one end of said reference plate member; a second marking guide arm connected at 90° to the other end of said reference plate member to form a generally U-shaped tool; a first lip member extending in a first direction perpendicular to said plate member and connected to one edge of said reference plate member to form a first right angle, corner-engaging member for engaging the corner of said at least one building member to properly position said reference plate member relative to said at least one building member; said first marking guide arm having first and second marking edges for locating a predetermined position along said at least one building member for receiving a second building member at a right angle; said second marking guide arm having first and second, marking edges for locating a predetermined position along said at least one building member for receiving a third building member at a right angle; and a second lip member extending in a second direction opposite to said first direction and connected at 90° to the center of said second marking guide arm to form a second right angle, corner-engaging member transverse to said first corner-engaging member for marking off a predetermined position to provide the proper centerline alignment of said second building member relative to said at least one building member, comprising the following steps:

a) aligning said tool with a first end edge of said at least one building member;

b) drawing a marking line across said at lest one building member using said first or second marking guide arm as a reference;

c) rotating the tool 180° and aligning said second corner-engaging member with the first end edge of said at least one building member;

d) drawing a pair of marking lines across said at least one building member using the first and second marking edges of said first marking guide arm as a reference;

e) rotating the tool 180° and aligning said second marking guide arm with said pair of marking lines;

f) drawing a second pair of marking lines across said at least one building member using the first and second marking edges of said first marking guide arm as a reference;

g) moving said tool and aligning said second marking guide arm with said second pair of marking lines;

h) drawing a subsequent pair of marking lines across said at least one building member using the first and second marking edges of said first marking guide arm as a reference;

i) moving said tool and aligning said second marking guide arm with said subsequent pair of marking lines;

j) drawing another pair of marking lines across said one at least building member using the first and second marking edges of said first marking guide arm as a reference;

k) repeating steps i) and j) above using said subsequent pair of marking lines for aligning said second marking guide arm and using the first and second marking edges of said first marking guide arm for drawing said another pair of marking lines until the remaining length of said at least one building member is less than the length of said tool; and l) moving the tool to a second end edge of said at least one building member and aligning said first marking guide arm with the second end edge of said at least one building member; and m) drawing a single marking line across said one or more building members using one of said first and second marking edges of said first marking guide arm as a reference.

* * * * *